United States Patent [19]

Inuzuka et al.

[11] 4,436,408

[45] Mar. 13, 1984

[54] IMAGE FORMING APPARATUS INCLUDING POWER SWITCH OPERATING MEANS

[75] Inventors: Tsuneki Inuzuka, Machida; Masato Ishida, Kawasaki; Hiroshi Tanioka, Tokyo; Hisashi Sakamaki, Yokohama, all of Japan

[73] Assignee: Canon Kabushiki Kaisha, Tokyo, Japan

[21] Appl. No.: 219,975

[22] Filed: Dec. 24, 1980

[51] Int. Cl.[3] ..... G03G 15/00

[52] U.S. Cl. ..... 355/14 R; 355/3 R; 335/63

[58] Field of Search ..... 355/14 R, 14 C, 3 R; 307/140, 141, 141.4; 361/114, 210; 335/38, 62, 63

[56] References Cited

U.S. PATENT DOCUMENTS 2,817,730 12/1957 Wilckens ..... 335/38 X
3,729,696 4/1973 Pope ..... 335/62
3,959,755 5/1976 Harper et al. ..... 335/63
4,222,659 9/1980 Komori et al. ..... 355/14 R

*Primary Examiner*—Richard L. Moses
*Attorney, Agent, or Firm*—Fitzpatrick, Cella, Harper & Scinto

[57] ABSTRACT

Copying apparatus including a processing unit for forming a visible image on a copy material, a process control device for operatively controlling the processing unit, and a manual power switch unit for supplying power to electric loads of the processing unit and the process control device. The manual power switch unit includes an actuator to maintain an On condition during the time from the beginning of manual turning on, to the activation of manual turning off, and a coil to release the On condition of the actuator before the activation of the manual turning off. The power switch unit further includes a power control device for driving the coil to release the actuator from the On condition to the Off condition after a predetermined time has elapsed since a completion of copying operations, wherein the power control includes a timer controlled by the process control device for driving the coil.

8 Claims, 8 Drawing Figures

IMAGE FORMING APPARATUS INCLUDING POWER SWITCH OPERATING MEANS

BACKGROUND OF THE INVENTION

1. Field of the Invention

This invention relates to an image forming apparatus including a copying apparatus or the like, more particularly to apparatus for controlling the switching of a power supply to the apparatus to promote an image forming process.

2. Description of the Prior Art

In addition to a copy start switch, a conventional copying apparatus has in general a main switch for supplying power to the electric loads within the machine for achieving such a processing as a charging or an exposing and the control unit which is provided to achieve a timing control for the loads. Various electric loads are normally activated by the main switch to operate a cooling fan or set a copying apparatus in a ready condition of "copy start."

However, those electric loads are frequently deenergized automatically after completion of copying in order to prevent noise caused by the fan or to save. The main switch is therefore so constructed to be activated only by a manual driving of a switch actuator and thereafter a relay holds a power line which is shut off by releasing the relay after the completion of copying.

The turning on or off of the power line is frequently accomplished or checked by an operator taking into consideration a position of the handle of the main switch. The operator would therefore be unsure of the condition of the machine if the acutator position is not definitely preset. Meanwhile, an additional mounting of a "manual off" switch for releasing a relay manually would make the apparatus construction complex. The conventional apparatus had thereon an exclusive safety circuit or a protection circuit to prevent the occurrence of a malfunction in the apparatus and suppress the overcurrent on the AC line.

SUMMARY OF THE INVENTION

It is an object of the invention to provide an image forming apparatus having a manual power switch to remove the drawbacks as described above.

It is an other object of the invention to provide a copying apparatus for permitting automatic shut-off or manual shut-off by using a timer after completion of copying without mounting thereon a manual power switch for off only.

It is still another object of the invention to provide a picture forming apparatus for achieving automatic power-off control by controlling a manual power switch and for protecting the control means from being overheated.

It is another object of the invention to provide apparatus for achieving manual power on-off and automtic power-off control by mounting thereon a power switch unit including a handle and control coil therein.

It is still another object of the invention to provide such a mechanism responsive to a malfunction that occurs therein.

It is another object of the invention to provide a picture forming apparatus having a power switch unit including a first coil and second coil to achieve power-off in response to the coil current on one of them.

BRIEF DESCRIPTION OF THE DRAWINGS

The above and other objects of the invention will be made clearer referring to an embodiment described below in conjunction with the accompanying drawings, in which.

DESCRIPTION OF THE PREFERRED EMBODIMENTS

Figure 1:
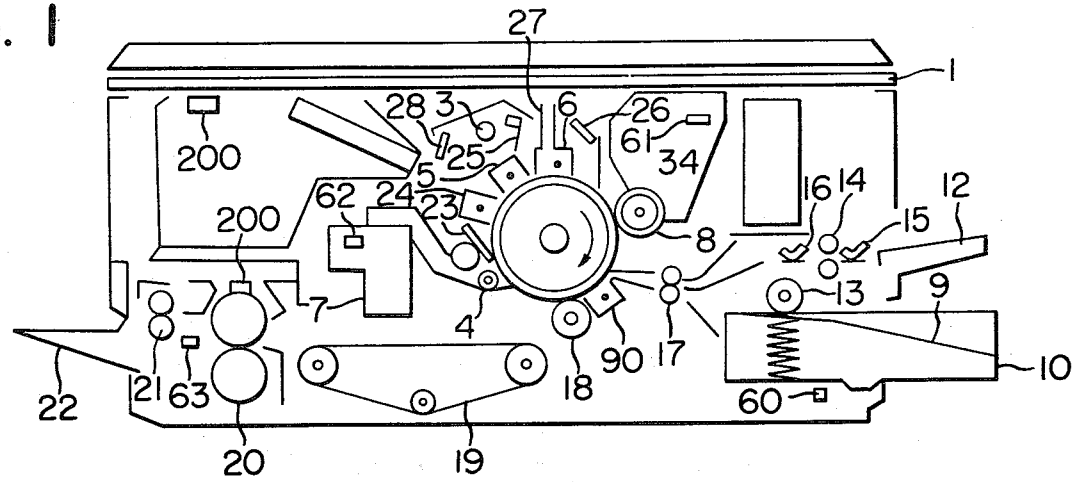
FIG. 1 is a cross-sectional view of a copying apparatus according to the invention.

A preferred embodiment according to the invention will be described below referring to the drawings.

A copying apparatus according to the invention, which is illustrated in FIG. 1, comprises in combination a platen 1 making a reciprocation, provided to rest thereon a manuscript or original document, a rotatable drum 2 having a sensitive film coated on its full surface, a lamp 3 adapted to expose the original document to project an image from the platen 1 to the drum 2, a corona charger 5 mounted to provide a positive charging for the surface of the sensitive film, another corona charger 6 adapted to provide a negative charging for the surface of the sensitive film together with an exposure image, a processor 8 provided to develop a electrostatic, latent image, a charger 9 provided to transfer the developed pictures to a copy sheet of paper 10, a dismountable cassette 11 provided to accommodate therein a multiplicity of copy paper sheets 10, a feed frame 12 for achieving manual feeding of the copy sheets 10 into the body, a roller 13 adapted to feed out the copy sheets from the cassette, a roller 14 adapted to feed the copy sheets from the manual feed frame 12, microswitches 15 and 16 provided to detect the manual feeding copy paper, a registration roller 17 mounted to align the front end of the copy paper with the edge of a drum, a roller 18 provided to separate the copy paper from the drum, a belt 19 adapted to transfer the copy paper, a fixing roller 20, a roller 21 mounted to discharge the copy paper to a tray 22, a blade cleaner 23 for removing the toner remaining in the drum, a magnet roller 4 adapted to collect the toner being removed with the blade 23, a container 7 provided to accommodate therein the toner collected in the roller 4, a negative corona charger 24 mounted to remove the residual charge in the drum, a shutter 25 adapted to provide, directly on the exposed surface of the drum, the light from the exposure lamp 3 during a predetermined time period, mirrors 26 and 28 mounted to reflect the light from the lamp 3 directly to the drum surface, and a Selfoc lens 27 provided to focus the reflective light from the original document exposed to the lamp 3 on the drum surface.

In operation, when the main switch is turned on, a motor for driving the drum 2 also is turned on, the lamp 3 is lighted, the shutter 25 is opened and the drum 2 is driven by turning the corona charger 6 on. Therefore, the drum surface is cleaned of residual toner, residual charge, and memory element characteristics beforehand. A fixing roller 20 generates a copy restart signal as the temperature of fixer reaches an appropriate level by utilizing an internal heater. The drum continues to rotate unless a copy switch is turned on, and the rotation of the drum is suspended when the pulses from a rotary encoder provided in a drum driving system to generate n unit of pulses every one rotation of the drum are counted by a predetermined number. The drum rotation as described above is termed "first prerotation." When the copy switch is turned on during the rotation or suspension of the drum, the shutter 25 is closed, the drum 2 resumes its rotation, the platen 1 advances after substantially one rotation (hereinafter is termed "second prerotation") to provide for the original loaded on the platen 1 slit exposure. The reflecting picture due to the lamp 3 is slit-exposed through the Selfoc lens on the drum. The sensitive film coated on the drum 2 includes the upper insulative layer, the intermediate photoconductive layer and the bottom conductive layer, and, when the surface charged with the charger 5 reaches the exposure surface, the positive charging may be electrically cancelled by the negative charger 6 and photo picture. When the full surface of the sensitive film meets with the exposure face, a electrostatic latent image having a high contrast is formed on the drum surface by the light from the mirror 26. The latent image appears as a positive image in the developing section by receiving the toner. The positive image is transferred by the transfer section to the copy paper in accordance with the positive potential level of the transfer charger. The copy paper is separated from the others in the cassette 10 by the timing operation of the paper feeding roller 13 to be fed as desired and passes through the transfer section at the same speed as the drum rotation by the registration roller 17. The transfer paper is separated in the roller 18, being fed from the belt 19 to the roller 20 to be picture-fixed and is discharged by the roller 21 to the tray 22. After completion of the transfer operation, the drum surface is cleaned by the blade 23, being electrically discharged by the charger 24, and is removed in memory by the light from the lamp 3 through the mirror 28. In order to gain continuous copying from the same document sheet, the reciprocal movement of the platen 1 is repeated by the number set by a ten-key pad in the operating section of the apparatus.

Figure 4:
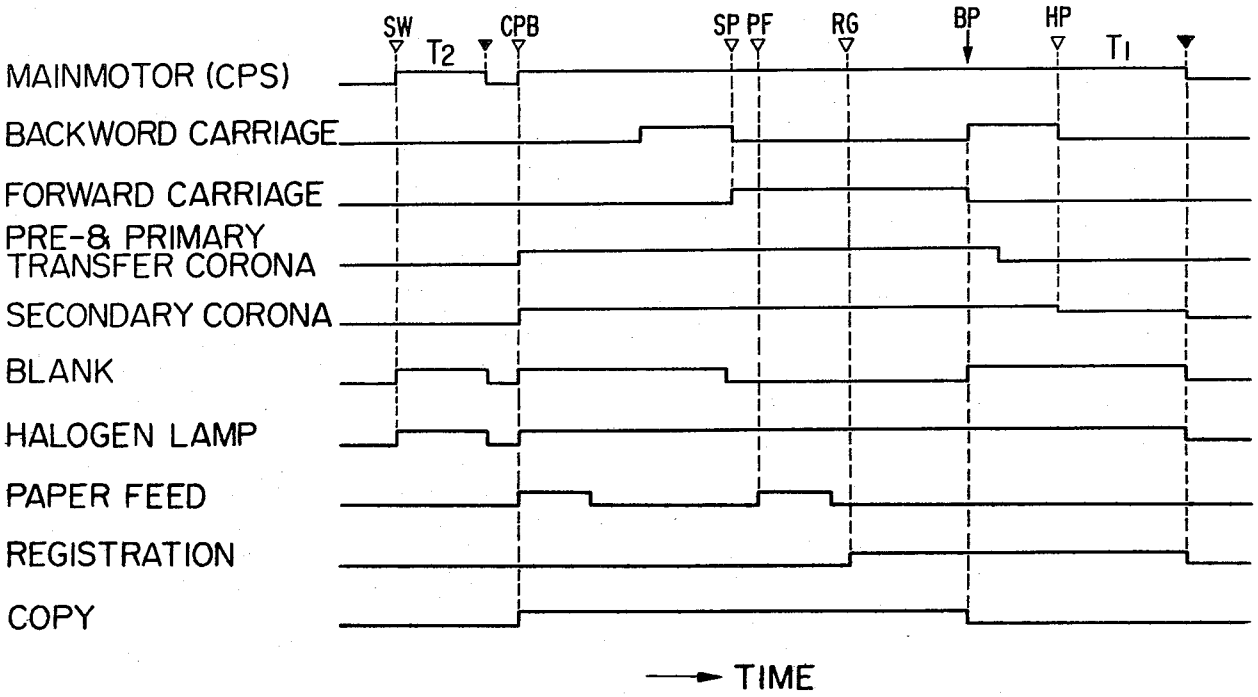
FIG. 4 is an operation time chart of the apparatus illustrated in FIG. 1.

FIG. 4 shows a time chart related to a single sheet of copy paper. It also shows the variations concerning conditions thereof.

Figure 2:
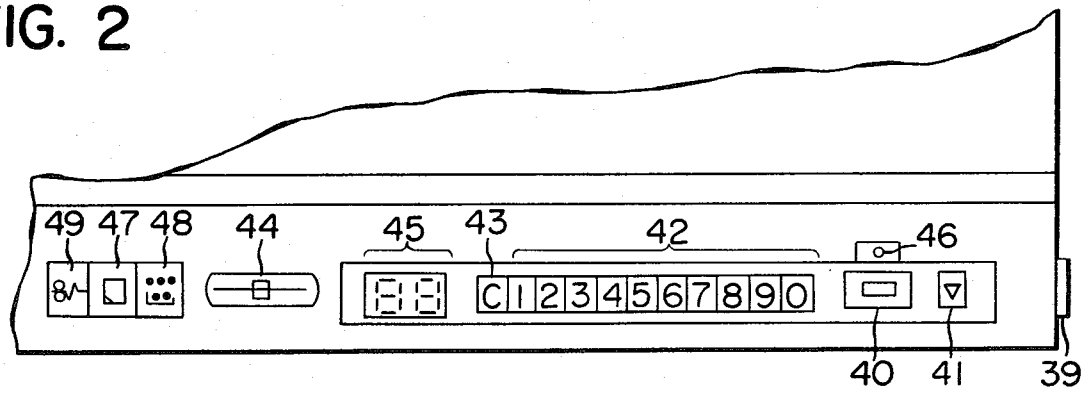
FIG. 2 is a plan view of the control section illustrated in FIG. 1.

Referring now to FIG. 2 illustrating the operation section of the copying apparatus, it comprises an electric source switch 39 (main switch), a key switch 40 for copy start, a stop key switch 41 for interrupting a continuous copying, a ten key 42 for storing in the memory its copying number to set the continuous copying number, a clear key 43 for clearing the number stored in the memory, a lever 44 for setting the density of the copying, a 7-segment indicator 45 for showing the memory number, a wait lamp 46 for defermining whether the fixing roller has reached a predetermined fixing temperature or not, a lamp 47 for displaying the absence of the cassette or the sheet therein and a lamp 48 for indicating that the container 7 for collecting the toner used is fully filled with the toner. A lamp 49 is turned on when the copying sheet causes jamming. When the jamming occurs, the clear key and ten key are not operated, but they can be operated in the waiting time.

The segment indicator 45 is so constituted that one suppressed by a zero can be indicated independently of the waiting duration by turning on the electric source switch 39, and further, a number reduced by one from the setting number is indicated after each completion of one copying cycle, and when a preset number of copyings have been completed, the indication of the preset number is resumed, whereby gaining a desired number of copyings without supplying the power to the ten key. If thirty seconds have passed without starting the copying thereafter, the numeral "1" is indicated on the indicator 45. By the method as described above, operator can resume the copying without presetting a predetermined number by the ten key and accordingly the resumption of smooth copying can be expected. When the standby time of thirty minutes has elapsed after the thirty seconds stated above, the main switch 39 is automatically shut off as described later.

The wait display unit 46 operates flashing on and off by turning on the source switch 39, but when the temperature of the fixing roller is not lowered below a fixing possible level, namely in a short time after the operator has turned the source switch 39 off, the display unit 46 is statically lighted. On the other hand, the unit 46 would flash at a temperature lower than the possible fixing level. It is to be noted that the display unit 46 is lighted stably also when the temperature of the fixing roller is increased up to the possible fixing level and the wait time has passed.

When the source switch 39 is turned off, the display unit displays only an off-condition of the power source without displaying a lighting or flashing condition.

An overflow indicator 48 is used for performing a significant display by detecting the overflow condition in the container 7 and for achieving a static lighting display by detecting shortage of the toner in the container 33 for developer. It is however understood that in the former case, the lamp can be turned on or off, while in the latter it can be statically lighted. A no paper display unit 47 can also be turned on or off in the absence of paper, while it can be statically lighted in the absence of a cassette.

If shortage of the toner in a hopper 33 or overflow of the collecting container 7 may be detected, the copying is continued until a preset number of copyings will be completed when the continuous copyings of the number preset by the ten key are executed, and thereafter the resumption of the copying is prevented. Such operation is performed to cover the weak point in that an alarm is issued, but a substantial copying speed may be decreased because a series of copying operations are disturbed by instant interruption thereof.

Figure 3:
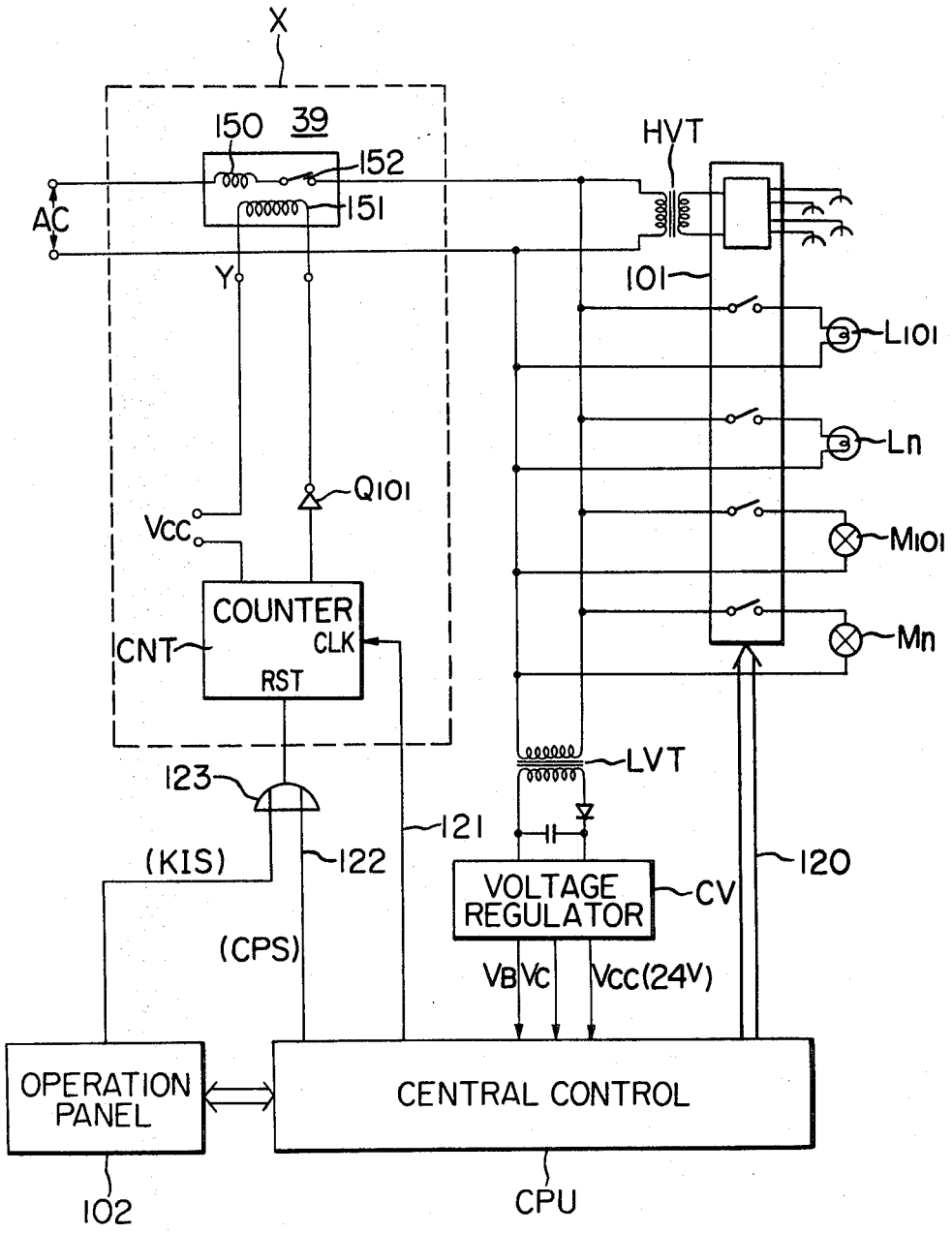
FIG. 3 is a schematic diagram of a control circuit of the apparatus of the invention.

FIG. 3 is a control circuit diagram of the copying apparatus according to the invention, in which the main switch 39 includes the switches and additionally a type unit having therein various windings. The unit 39 has an overcurrent detecting winding 150 and switch contact 152 (actuator) and is so operated that the contact 152 is forcibly opened by excitation of the coil 150 (first coil) when the over-current greater than a predetermined level may be applied thereto. The main switch unit 39 has also a function of a circuit breaker therefor. The main switch unit 39 additionally has a winding 151 for external trip, being excited as by the winding 150 by supplying the current to the winding 151 and the switch contact 152 can be forcibly opened before the manual off operation. Therefore, the main switch can be automatically cut off. However, because the switch contact 152 is provided in the exterior of the body, it can be manually operated.

HVT indicates a high tension transformer for applying a high voltage to the chargers necessary for the copying operation, $L_{101}$ through $L_n$ indicate such the load as a main motor or a fan motor for driving the drum and/or roller. LVT indicates a low tension transformer for decreasing the voltage of 50 Hz/100 V, CV is a stabilized electric source for constituting various DC source $V_b$, $V_c$, and $V_{cc}$ obtained by regulating the voltage from the LVT, rectified by a rectifier Rec, and CPU is a central control unit having a known microcomputer μCOM, which is provided to achieve the timing control of the loads to promote the copying action as shown in the time chart of FIG. 4 and store in a memory a key signal entered from the operation unit 102 illustrated in FIG. 2. CNT is a counter for counting clock pulses CL transferred from the CPU thereto over a line 121 and serves to set the counter during the time at which a signal is being applied to a reset terminal RST. The clock pulses CL are obtained by dividing the frequency of the 1 μsec pulses from an oscillator in μCOM for promoting running of the microcomputer μCOM. Q101 is a driver having an amplifier, for driving the winding.

However, the microcomputer μCOM is provided with a memory ROM in which are stored program sequences for achieving the time control sequence in FIG. 4, a key entry program and a program for controlling the start and completion of the sequence by using an entry signal. A power source for the μCOM is indicated at Va.

In operation, when the main switch contact 152 is turned on, to connect the power source to the LVT, DC source $V_c$, $V_a$ and $V_{cc}$ generated through the regulated source CV are applied to the CPU, counter CNT and operating panel 102. Subsequently, when an active copy key 40 is turned on, an "on" signal is applied to the CPU which discriminates the "on" signal to be processed to supply a control signal for cycle start to the loads desired through the lead 120 and copying operation starts by turning on a lamp 101, main motor M101, high voltage output components. A copy signal CPS is applied on the lead 122 to the reset terminal of the counter CNT, together with the output signal of the lead 120 to reset the counter CNT in its initial condition.

During the copying operation or when the main motor is driven, the copy signal CPS is applied to the reset terminal RST and during that period the counter CNT holds a reset condition.

When the copying has been completed and the main motor is turned off after passage of a standby mode $T_1$, the copy signal CPS is turned off. After that time, the counter CNT begins counting of the clock pulse CL. After completion of the copying, if not resuming the copying, when a count in the counter becomes equivalent to a count corresponding to a preset time period, a count-up signal is applied from the counter CNT to the driver Q101 to turn on the tripping winding 151 and break the contact 152 of the main switch 39. Therefore, it is to be noted that the apparatus can contribute to energy saving by turning off the power for the fan or the heater and remove the noises due to the fan or the like. When the power source is thrown in by turning the switch 152 on again, the copying can be resumed because the main motor is driven and the counter CNT is reset by the RST. However, when the copy key 40 is not turned on as shown in FIG. 4, the main motor is automatically suspended after passage of a predetermined time $T_2$. Therefore, the counting starts because the resetting of the counter CNT is released and the counter effects the auto-off control of the switch 152 as described above.

However, the resetting of the counter CNT can be performed by a key input signal of the operation unit even during counting of the clock CL. The circuit for the above resetting can be established by applying a key input signal according to the ten key and copy key KIS through the lead 123 to the reset terminal as shown in the dotted line of FIG. 3. The power source is cut off as in not turning the copy key on for a predetermined time after activation of the ten-key. According to such processing, the operative characteristics will be improved more in that even when the copying is not effected, the counter can be reset by the key activation and the counting starts when the machine may be completely free from the operation by an operator.

When the main motor is suspended to interrupt the copying because of the jamming or the absence of a copy paper sheet, the resetting condition can be maintained because the copy signal CPS has still remained resided. The preset copying number can be held also when the operator would want to preferentially copy a specific paper sheet in the course of the copying, but the counter remains reset because the signal CPS is not cancelled in the case described above. After releasing of the jamming or release of the CPS due to a clear key during interruption of the copying, however, a counting of the timer CNT starts and the aforementioned auto-shut control is established by counting up.

In this apparatus as described above, the main switch is automatically cut off directly without using any relay. Therefore, the performance having a high reliability can be obtained with inexpensive components. It is also noted that the power supply to the control coil 151 in the main switch is automatically cut after turn-off to prevent heat generation of the coil. A signal representative of malfunctioning such as jamming may cause copy signal CPS to be cancelled to start the counting operation of timer CNT. During such interruption, the 30-second timer for resetting numeral indicator 45 to its initial indication "1" is inhibited from operating, so as to indicate a number which was indicated before the interruption. Clearing the jamming will restart the timer.

Figure 5:
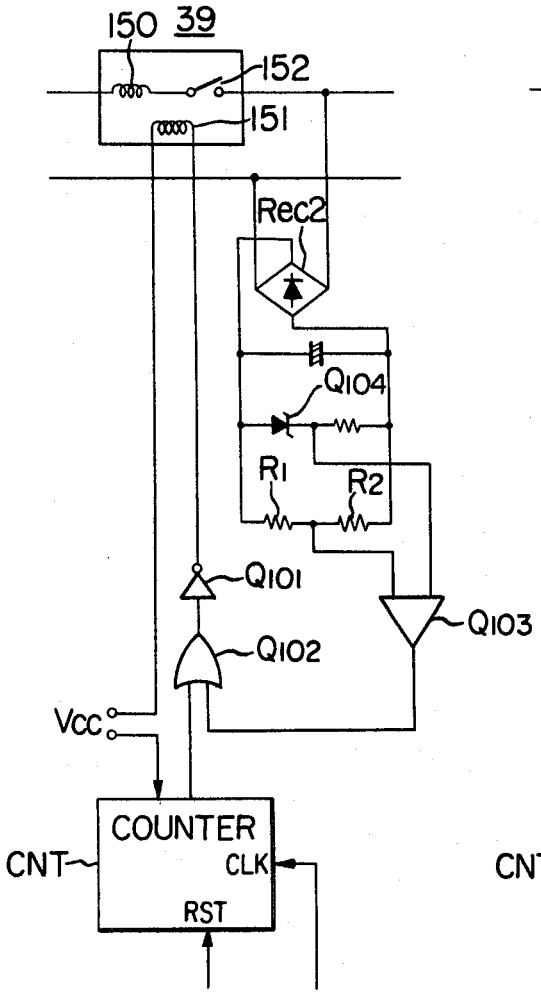
FIGS. 5 through 7 are schematic diagrams of other control circuits of the apparatus according to the invention.

A circuit illustrated in FIG. 5 is provided to excite the winding for forcibly opening the main switch by detecting a rising of the source voltage and includes a rectifier Rec 2, fault detecting resistor $R_1$ and $R_2$, a constant diode Q104 used for standard voltage source, a comparator Q103 and an or gate Q102.

Figure 6:
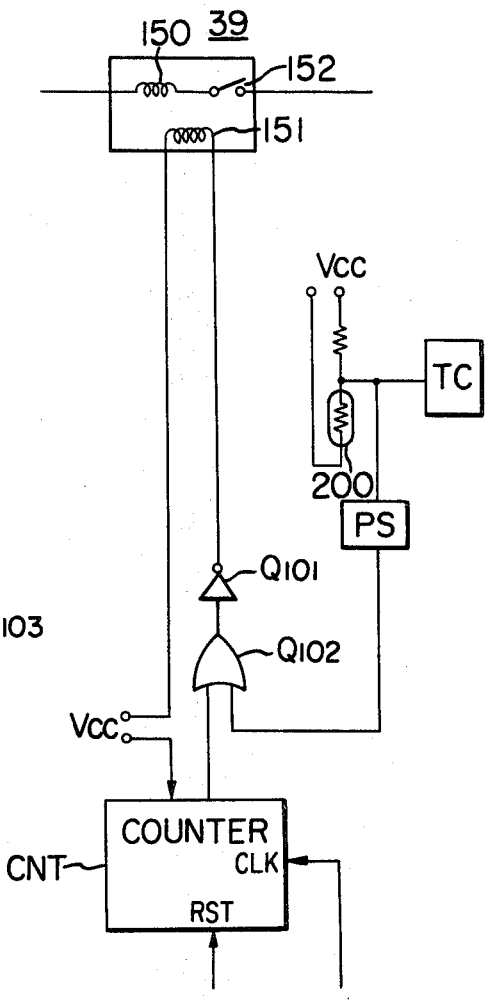

A circuit illustrated in FIG. 6 is utilized to excite the winding for forcibly opening the main switch by detecting rising temperature of the fixing roller, and such circuit has a thermistor provided close to or in contact with the first roller to detect the temperature of the fixing roller as shown in FIG. 1 and a control circuit TC for controlling a heater provided in the roller at a predetermined temperature level.

According to the invention, a desirable objective is established by replacing the circuit shown in FIGS. 5 and 6 with a circuit X of FIG. 3 and the safety characteristic of the apparatus can be remarkably improved by connecting all the components to be detected to the or gate Q102.

Referring now to FIG. 5, when the source voltage may be over a predetermined voltage level, the element Q103 recognizes that the divided voltage due to the resistor R1 and R2 may be higher than the element voltage on the Q104 and the power if supplied to the or gate Q102 to forcibly cut off the main switch 152. After the cut-off of the main switch, if the voltage is not returned to a normal level, the main switch remains cut off in spite of its throwing. If the voltage level may be at the normal level, the main switch can be thrown in. When the regulator circuit CV may vary over a voltage regulation controllable region, therefore, a protection for the circuit can be achieved and the circuit becomes more safe.

In FIG. 6, due to the fact the the thermistor 200 positioned near the lamp 5 or platen glass 1 can detect the temperature of the platen raised by the heat from the lamp, it is possible to protect the glass from being broken down by opening the main switch.

Figure 7:
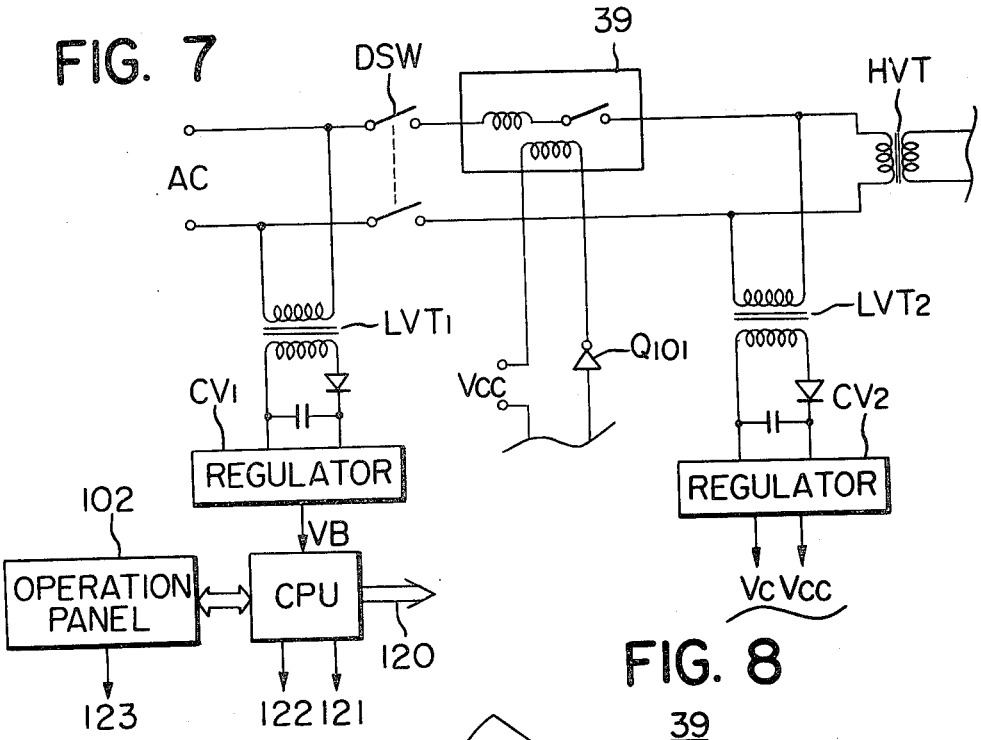

A circuit illustrated in FIG. 7 is different from that shown in FIG. 3 and is constructed so that the power source Va for the CPU can be obtained from a component other than the main switch unit 39, taking into consideration its position to maintain the active condition of the CPU regardless of the cut-off of the main switch. Therefore, the measurement or display on the operation suspending time of a machine, for example, even during interruption of the copying can be performed and the resumption of the operation can be executed more smoothly. DSW is used for a door switch to turn the machine off by opening the side plate of the machine and can cut off the power source provided in the machine when the jamming is removed. Though it is dangerous that the door switch DSW is interposed between the HVT and LVT2, it can be used only to turn the power supply off.

Figure 8:
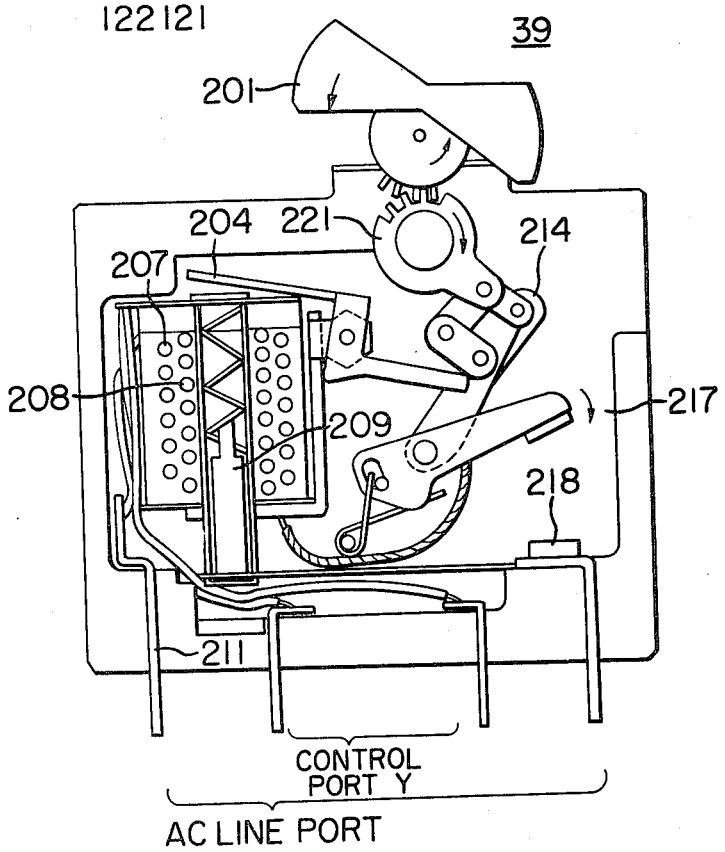
FIG. 8 is a cross-sectional diagram of the power switch unit illustrated in FIGS. 1, 3 and 5 through 7.

FIG. 8 is a cross-sectional detailed diagram of the typical power switch unit 39 illustrated in FIGS. 3 and 5 through 7. However, the power switch unit 39 in the same figure is in a power-off condition and the machine is turned on by operating a switch actuator device 201 to the direction of the arrow. A ring 211 is provided to make a rotation by action of the handle 201, a contact 217 is operated in response to the revolution of the ring, a contact 218 is used for a contact for performing power supply in contact with the contact 217, and the power switch unit 39 includes additionally the first coil 207(151), the second coil 208(150), a movable core 209 and an armature 204. When the actuator 201 is moved in the direction of the arrow, the core 209 is elevated upward by the drive current of the coil 207 and the overcurrent of the coil 208, as a result the inductance is therethrough increased and the exciting force due to the coils also increases. The armature 204 is attracted to drive the ring 221 and contact 217 in a direction opposite to the arrow. Accordingly, the actuator 201 is returned to a position as illustrated and the AC line is shut off. Because no current is applied to a control port Y by interruption of the power supply to the AC line, the excitation due to the coil 207 and 208 may be faded away and the armature 204 is returned to the position illustrative. It is therefore possible to protect the coils from being overheated. And also the contacts 217 and 218 can be freely switched on or off by the action of the actuator 201 independently of the armature. The actuator 201 can also be constructed in a momental button type configuration.

What we claim is:

1. Copying apparatus comprising:

process means for forming a visible image on a copy material;

process control means for operatively controlling said process means;

a manual power switch unit for supplying power to electric loads of said process means and said process control means, said manual power switch unit including switch contacts and manually activated actuator means to maintain an "on" condition of said contacts during the time from the beginning of manual turning on to activating of manual turning off, and said power switch unit further including a coil to release the "on" condition of said actuator means before the manual activation thereof to turn "off" said contacts;

timer means for measuring the time lapse from completion of copying operation, said timer means being controlled by said process control means;

power control means for driving said coil to release said actuator means from the "on" condition to the "off" condition when a predetermined period of time is measured by said timer means; and input means comprising instruction keys, wherein the measuring operation of said timer means is reset by operation of a said instruction key.

2. Copying apparatus as claimed in claim 1 wherein said timer means is inhibited from operating during interruption of copying operations.

3. Copying apparatus as claimed in claim 1 wherein said process control means has a clock pulse generator, and said timer means counts clock pulses from said pulse generator to drive said coil.

4. Copying apparatus as claimed in claim 1 wherein said power switch unit further comprises a second coil connected for automatically activating said switch actuator means in response to overcurrent passing through said second coil.

5. Copying apparatus as claimed in claim 1, wherein said timer means is reset to commence its typing function upon operation of said instruction key.

6. Image forming apparatus comprising:

process means to form a visible image on a copying material;

process control means for operatively controlling said process means, said process control means including a microcomputer for achieving timing control for said process means;

a manual power switch unit for supplying power to electric loads of said process means, said manual power switch unit including means responsive to manual activation, and a first and second coil for releasing said responsive means, said second coil being responsive to overcurrent on an AC line connected to said apparatus; and power control means for driving said first coil to release said responsive means automatically after completion of an image forming process or after the occurrence of a malfunction.

7. Image forming apparatus as claimed in claim 6 wherein said process control means includes a microcomputer, and wherein power supplied to said computer is continued independently of driving of said coils.

8. Copying apparatus as claimed in claim 5 wherein the occurrence of said malfunction is caused by an abnormal rising of temperature in an exposure means or a fixing heater.

* * * * *

UNITED STATES PATENT AND TRADEMARK OFFICE

CERTIFICATE OF CORRECTION

PATENT NO. : 4,436,408

DATED : March 13, 1984

INVENTOR(S) : TSUNEKI INUZUKA, ET AL.

It is certified that error appears in the above-identified patent and that said Letters Patent is hereby corrected as shown below:

COLUMN 1

Line 25, after "save" insert --power--.

Line 47, "an other" should read --another--.

COLUMN 2

Line 36, "a" (second occurrence) should read --an--

COLUMN 3

Line 4, after "of" insert --the--.

Line 15, delete "is".

Line 25, "a" should read --an--.

Line 62, "defermining" should read --determining--.

COLUMN 4

Line 14, before "operator" insert --the--.

Line 24, "fixing possible" should read --possible fixing--.

COLUMN 5

Line 7, "such" should read --that--.

Line 8, "as" should read --is--.

COLUMN 6

Lines 25 and 26, "has still remained resided" should read --remains--.

Line 37, delete "the".

UNITED STATES PATENT AND TRADEMARK OFFICE

CERTIFICATE OF CORRECTION

PATENT NO. : 4,436,408

DATED : March 13, 1984

INVENTOR(S) : TSUNEKI INUZUKA, ET AL.

It is certified that error appears in the above-identified patent and that said Letters Patent is hereby corrected as shown below:

COLUMN 7

Line 5, "if" should read --is--.

Line 9, "throwing" should read --actuation--.

Line 62, "illustrative" should read --illustrated--.

COLUMN 8

CLAIM 5, Line 2, "typing" should read --timing--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*